US006756080B2

(12) United States Patent
Ballu

(10) Patent No.: US 6,756,080 B2
(45) Date of Patent: Jun. 29, 2004

(54) INSTALLATION FOR SPRAYING COATING PRODUCT AND PROCESS FOR CLEANING SUCH AN INSTALLATION

(75) Inventor: Patrick Ballu, Reims (FR)

(73) Assignee: Sames Technologies, Meylan (FR)

( * ) Notice: Subject to any disclaimer, the term of this patent is extended or adjusted under 35 U.S.C. 154(b) by 309 days.

(21) Appl. No.: 10/078,538

(22) Filed: Feb. 21, 2002

(65) Prior Publication Data

US 2003/0157261 A1 Aug. 21, 2003

(30) Foreign Application Priority Data

Feb. 6, 2002 (FR) ..... 02 01418

(51) Int. Cl.[7] ..... B05D 1/00
(52) U.S. Cl. ..... 427/421; 118/302; 118/323
(58) Field of Search ..... 118/302, 323; 427/421

(56) References Cited

U.S. PATENT DOCUMENTS 6,179,217 B1 1/2001 Yoshida et al.

FOREIGN PATENT DOCUMENTS

EP 0 792 695 A2 9/1999
EP 0 967 017 A1 12/1999

*Primary Examiner*—Bernard Pianalto
(74) *Attorney, Agent, or Firm*—Browdy and Neimark, P.L.L.C.

(57) ABSTRACT

The installation according to the invention comprises at least one robot of which a mobile part supports at least one sprayer and a tank of coating product connected thereto for feeding the sprayer. The robot bears a second tank adapted to be filled with cleaning product, this second tank being connected to feed cleaning product to the tank of coating product, the sprayer and/or the conduits connecting the first tank to the sprayer.

The first tank, the sprayer and/or the conduits can be cleaned in masked time.

22 Claims, 5 Drawing Sheets

INSTALLATION FOR SPRAYING COATING PRODUCT AND PROCESS FOR CLEANING SUCH AN INSTALLATION

FIELD OF THE INVENTION

The present invention relates to an installation for spraying coating product and to a process for cleaning such an installation.

BACKGROUND OF THE INVENTION

EP-A-0 274 322, for example, discloses using a tank mounted at the end of the polyarticulated arm of a multi-axis robot for feeding coating products to a sprayer supported by this arm, particularly in the case of an installation for spraying an electrically conducting coating product by means of a sprayer of electrostatic type. In this known installation, it is provided to periodically connect the tank and the sprayer to a circuit of cleaning product, in order to eliminate any coating product remaining in the tank, in the sprayer and in conduits connecting this tank and this sprayer, at the end of a spraying phase. In effect, it is essential to eliminate any trace of one coating product before introducing a fresh coating product in the tank.

In this known installation, the tank must be cleaned before being filled with fresh coating product, which involves immobilizing the robot for a relatively long period, during which it cannot be used for spraying the coating product.

It is a more particular object of the present invention to overcome these drawbacks by proposing a novel installation which enables the time during which a sprayer is not productive to be reduced.

SUMMARY OF THE INVENTION

To that end, the invention relates to an installation for spraying coating products comprising at least one robot of which a mobile part supports at least one sprayer and a tank of coating product connected thereto for feeding the sprayer. This installation is characterized in that the robot bears a second tank adapted to be filled with cleaning product, this second tank being connected in order to feed cleaning product to the tank of coating product, the sprayer and/or the conduits connecting the tank to the sprayer.

Thanks to the invention, the contents of the second tank may be used for cleaning the tank of coating product, the sprayer and/or the conduits associated therewith, as soon as a step of spraying coating product has terminated, i.e. before the robot has positioned its sprayer and tank with respect to means located at a fixed station and provided to feed it with coating products. In other words, the time taken by the robot to move from its position of spraying towards its position of filling with fresh coating product, may advantageously be used for cleaning the tank of coating product, the sprayer and the conduits associated therewith, from the contents of the second tank.

According to advantageous but non-obligatory aspects of the invention, this installation incorporates one or more of the following characteristics:

- The second tank has an internal volume allowing it to contain a sufficient quantity of cleaning product to clean the tank of coating product, the sprayer and/or the conduits associated therewith, at least twice. This aspect of the invention makes it possible to reduce the frequency of filling of the second tank with respect to the frequency of filling of the tank of coating product.

- The second tank is mounted on the robot in the vicinity of the tank of coating product.
- First connection means, located at a fixed station in the vicinity of the robot and second connection means mounted on the robot and connected to the second tank are provided, these first and second connection means being adapted to establish a connection between a circuit for feed of cleaning product and the second tank. In these cases, the second connection means are advantageously adapted to be connected to the first connection means when first and second principal connection means, provided respectively at a fixed station and on the robot, are connected for filling the tank of coating product. In addition, the first principal connection means may be provided to comprise different connectors, each connected to a circuit for feed of a predetermined coating product, a first connection means for feeding the second tank being arranged in the vicinity of each of these connectors.
- The robot bears a third tank connected to the tank of coating product, to the sprayer and/or to conduits connecting the tank to the sprayer, this third tank being adapted to receive at least part of the residues of cleaning of the tank of coating product, the sprayer and/or the conduits mentioned above. This third tank makes it possible temporarily to store the essential of the cleaning residues. This third tank may be provided to be mounted on the robot in the vicinity of the tank of coating product and of the second tank. Means for connecting the third tank to a dump circuit are advantageously provided.
- The second tank and possibly the third tank may be piston tanks or tanks with deformable wall.

The invention also relates to a process for cleaning an installation as described hereinabove and, more specifically, a process for cleaning an installation for spraying coating products comprising a tank of coating product and a sprayer associated therewith, this tank and/or this sprayer being mounted on a multi-axis robot, characterized in that it comprises a step consisting in feeding the tank, the sprayer and/or the conduits connecting the tank to the sprayer, with cleaning products from a second tank mounted on the robot.

According to advantageous aspects of the invention, this process may include one or more of the following characteristics:

- The tank of coating product, the sprayer and/or the conduits are fed with cleaning product from the second tank at the end of a step of spraying coating product, preferably before the tank of coating product is filled again.
- The second tank is fed with cleaning product at the same time as the tank of coating product is filled.
- The residues of cleaning of the tank of coating product, the sprayer and/or the conduits are at least partly stored temporarily in a third tank mounted on the robot. In that case, a step is advantageously provided, consisting in pouring the contents of the third tank in a dump circuit. Depending on the variants, this step of pouring the contents of the third tank takes place before or after a step of filling the second tank with cleaning product. In a variant, steps may be provided, consisting in alternately connecting the second tank to a circuit for feeding cleaning product and the third tank to the dump circuit, using common connection means provided on the robot.
- The step consisting in pouring the contents of the third tank towards the dump circuit and/or the step consisting in filling the second tank take place simultaneously to the filling of the tank with coating product.

The tank of coating product, the sprayer and the conduits are cleaned by streams of air and cleaning product.

BRIEF DESCRIPTION OF THE DRAWINGS

The invention will be more readily understood on reading the following description of four forms of embodiment of an installation in accordance with its principle and of the process for cleaning thereof, given solely by way of example and made with reference to the accompanying drawings, in which.

DESCRIPTION OF PREFERRED EMBODIMENTS

Figure 1:
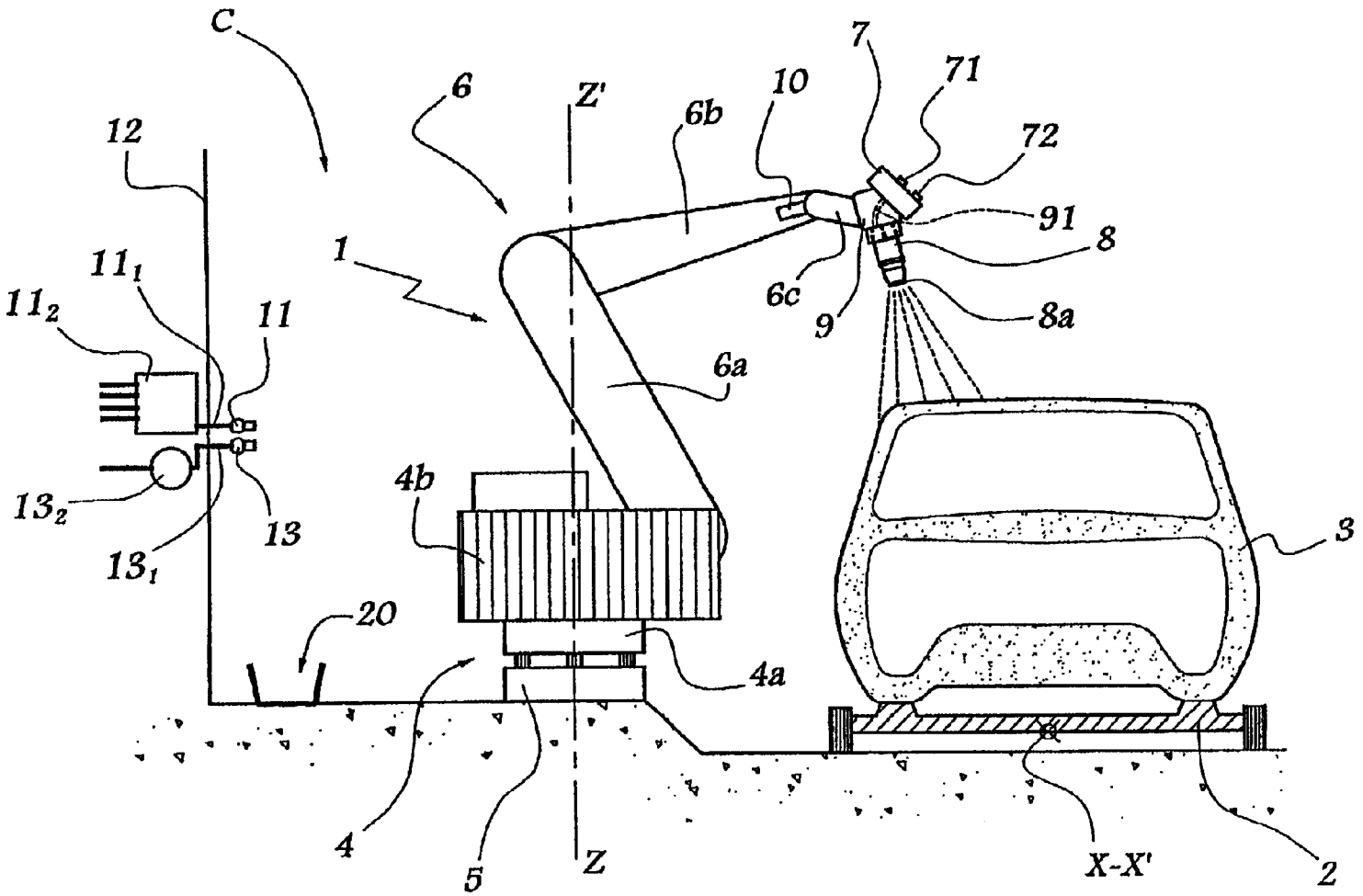
FIG. 1 schematically shows an installation according to the invention for spraying coating product, in the course of being used for spraying a coating product.
Figure 2:
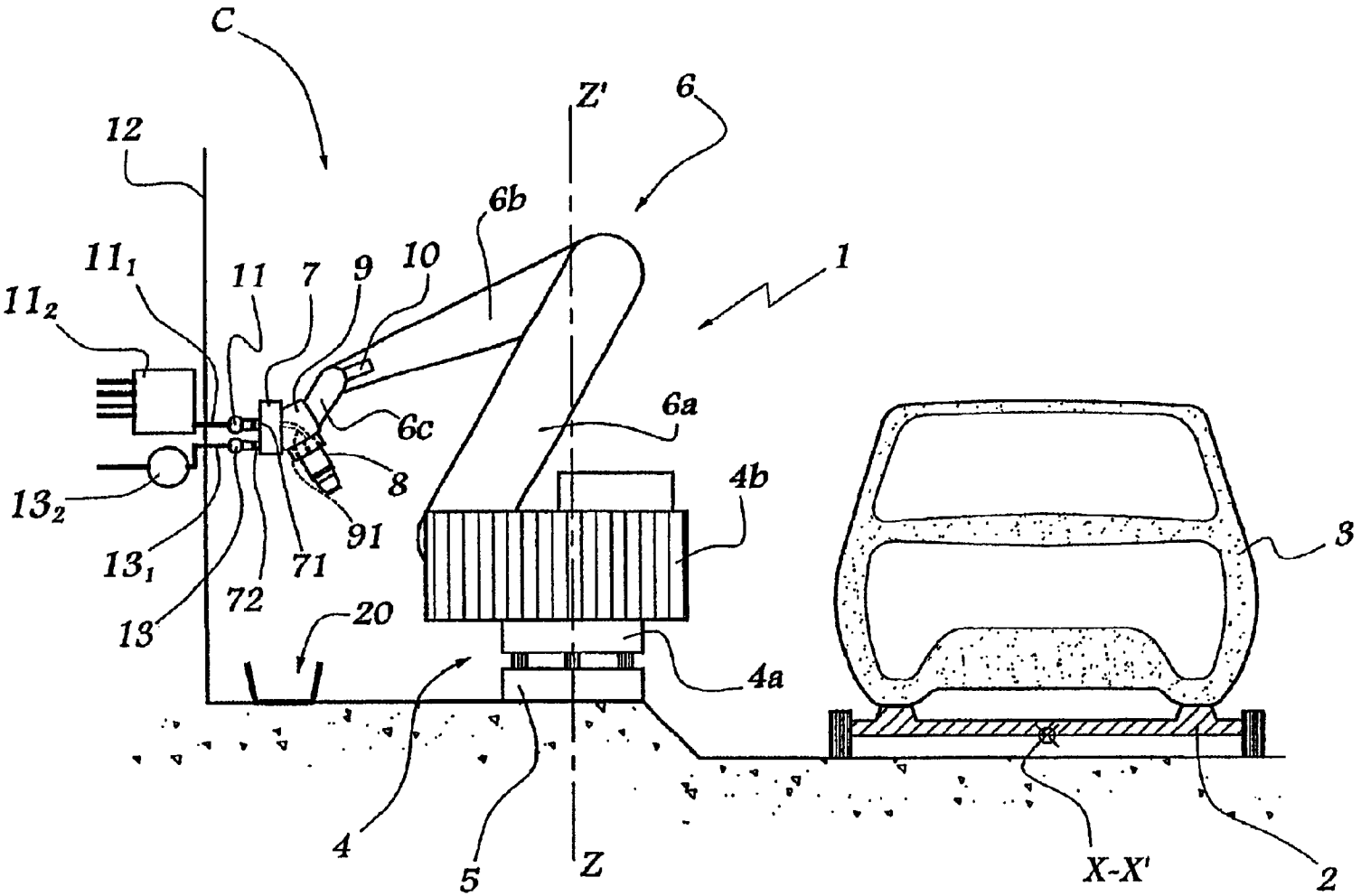
FIG. 2 is a view similar to FIG. 1 during filling of the tank of coating product used in the installation of FIG. 1.

Referring now to the drawings, and firstly to FIGS. 1 and 2, the installation according to the invention comprises an automat or robot 1 which is disposed in the vicinity of a conveyor 2 transporting the objects to be coated, in the present case automobile vehicle bodies 3. The robot 1 is of multi-axis type and comprises a chassis 4 mobile on a guide 5 extending parallel to the direction of conveyance X–X'. An arm 6 is supported by the chassis 4 and comprises a plurality of segments 6*a*, 6*b*, 6*c*, articulated with respect to one another. The chassis 4 is constituted by parts 4*a* and 4*b* articulated with respect to each other about a substantially vertical axis Z–Z'.

The segment 6*c* of the arm 6 supports an assembly comprising a tank 7, a sprayer 8 and a plate 9 in which are arranged conduits connecting the tank 7 to the sprayer 8, one of these conduits being shown in FIGS. 1 and 2 with reference 91.

The sprayer 8 is of electrostatic type and is connected to a high-voltage generator (not shown). The product contained in the tank 7 may be a water-soluble paint or a solvent-based paint.

In the configuration of FIG. 1, the sprayer 8 is used for spraying coating product, coming from tank 7, onto the body 3.

A second tank 10 is mounted on the robot 1, in the vicinity of the segment 6*c* and is connected, by conduits (not shown), to the tank 7, to the sprayer 8 and to the plate 9. This tank 10 is provided to be filled with cleaning product, which may be a solvent of the coating product contained in the tank 7. In practice, the nature of the cleaning product is adapted to the type of coating product transiting through the elements 7 to 9.

In a variant, the tank 10 might be mounted on the plate 9 and/or attached to the tank 7.

At the end of spraying of the coating product on the body 3, and before the robot reaches the position of FIG. 2 where the tank 7 is filled with coating product again, the contents of the tank 10 may thus be used for cleaning elements 7, 8 and 9.

This cleaning step can take place simultaneously to the displacement of the sprayer 8 from its position of FIG. 1 towards its position of FIG. 2, i.e. in masked time. To that end, a container 20 for collecting used cleaning product is provided in the booth C, near the foot of the partition 12. This container collects the product having served to clean the terminal part 8*a* of the sprayer 8 and may be connected to a dump circuit for evacuating the used cleaning product.

The tank 7 is provided on its outer surface with a first connector 71 intended to cooperate with a connector 11 provided at a fixed station on a partition 12 of the spraying booth C in which the robot 1 is installed. The tank 7 is also provided with a second connector 72 intended to cooperate with a second connector 13 disposed in the booth C, in the vicinity of the connector 11.

The connector 11 is connected by a conduit $\mathbf{11}_1$ to a unit $\mathbf{11}_2$ for changing coating product which makes it possible to feed the connector 11 with different coating products, depending on the nature of the product to be sprayed on the next body 3 arriving opposite the robot 1.

As for the connector 13, it is connected by a conduit $\mathbf{13}_1$ to a source $\mathbf{13}_2$ of cleaning product. The connector 11 is connected to the interior of the tank 7 while the connector 72 is connected to the interior of the tank 10.

In this way, when the tank 7 is presented opposite the connectors 11 and 13, the tank 7 is filled with coating product at the same time as the tank 10 is filled with cleaning product.

According to a variant of the invention (not shown), it is possible to provide for the tank 10 a sufficient capacity to allow two successive cleanings of the tank 7, the sprayer 8 and the plate 9. In that case, the tank 10 is not necessarily filled each time the tank 7 is filled. In a variant, the capacity of the tank 10 may be such as to allow more than two cleanings of elements 7, 8 and 9.

Figure 3:
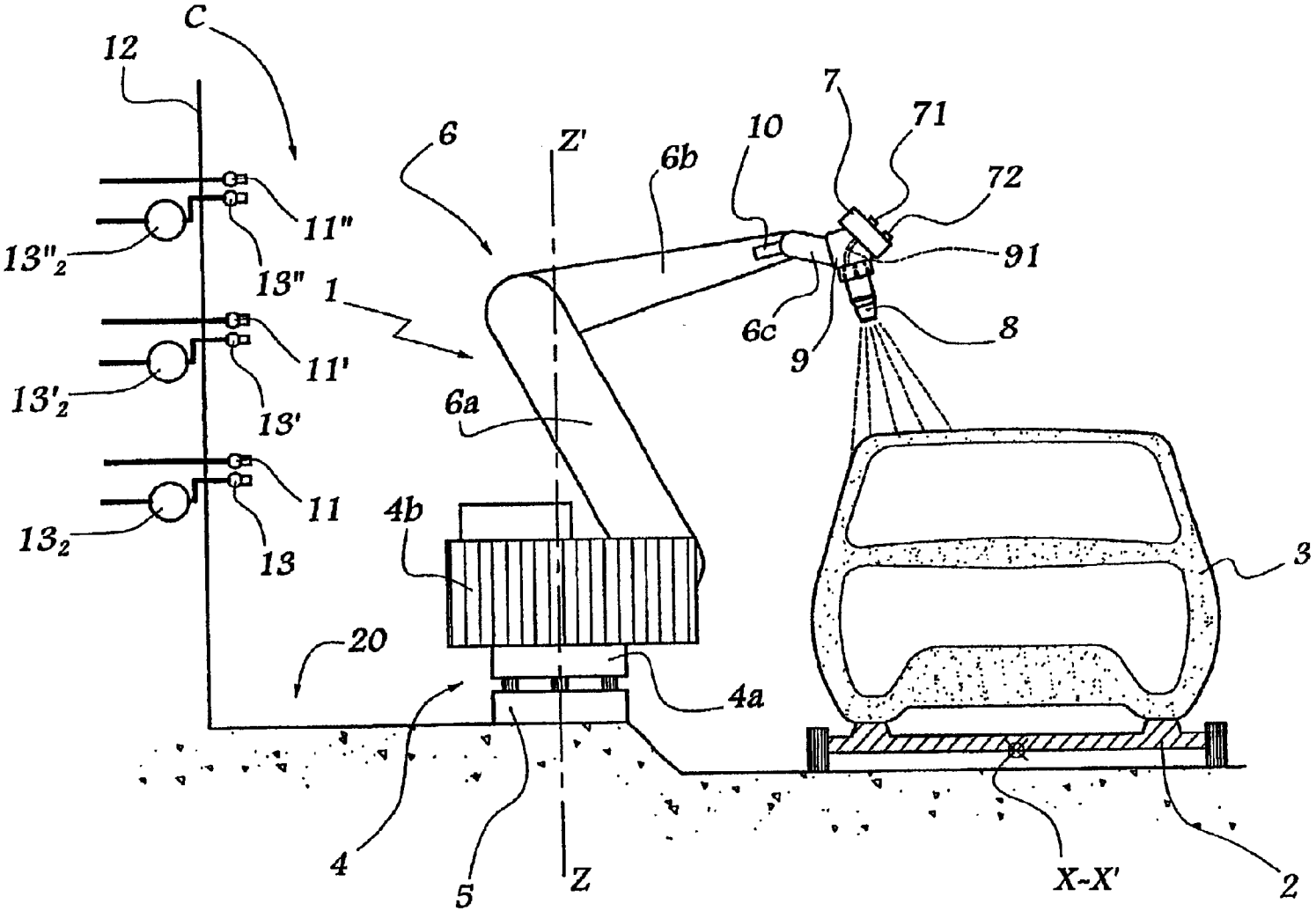
FIG. 3 is a view similar to FIG. 1 for an installation in accordance with a second form of embodiment of the invention.

As shown in FIG. 3, it is possible to provide a plurality of connectors 11, 11' and 11" of the type of connector 11 and a plurality of connectors 13, 13' and 13" of the type of connector 13 each connected to a source $\mathbf{13}_2$, $\mathbf{13'}_2$ or $\mathbf{13"}_2$ of cleaning product. This avoids having to resort to a phase of cleaning of the unit for changing the coating products, of the type of unit $\mathbf{11}_2$ of the first embodiment, when a change of shade is made between two successive bodies 3. The fact that a connector 13, 13' or 13" is provided in the vicinity of each connector 11, 11' or 11" makes it possible to fill the tank 10, as mentioned hereinabove with reference to the first embodiment, independently of the choice of the fresh coating product to be used, i.e. of the choice of the connector 11, 11' or 11".

Figure 4:
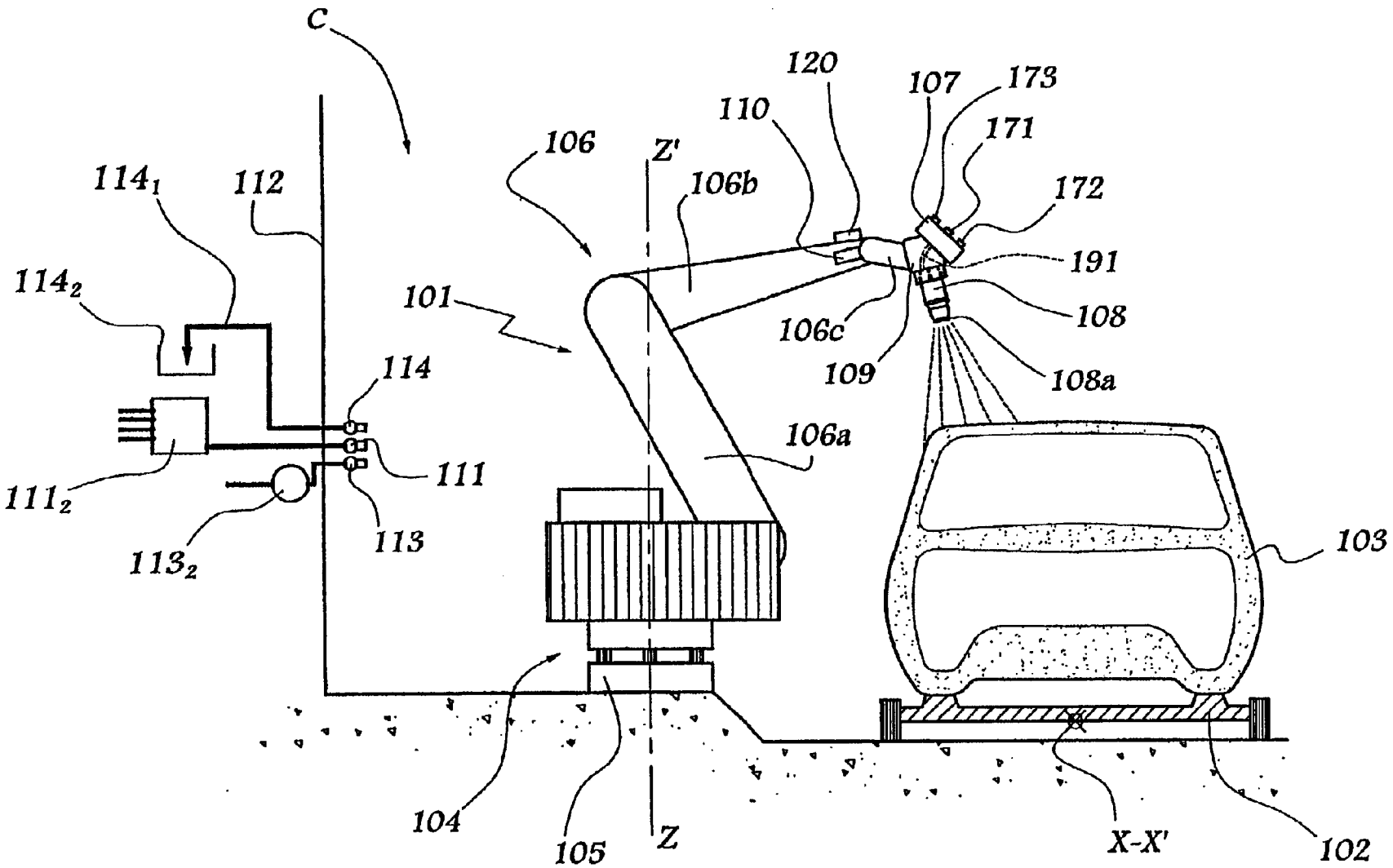
FIG. 4 is a view similar to FIG. 1 for an installation in accordance with a third form of embodiment of the invention.

In the third embodiment of the invention shown in FIG. 4, elements similar to those of the first embodiment bear identical references increased by 100. The robot 101 of this embodiment is disposed opposite a conveyor 102 over which bodies 103 of automobile vehicles advance. The robot 101 comprises a chassis 104 mobile over guide 105 and an arm 106 comprising a plurality of segments 106*a*, 106*b* and 106*c*. A tank 107 is mounted on the arm 106*c* and is associated with an electrostatic sprayer 108 to which it is connected thanks to a plate 109 in which conduits are arranged, one of which is shown with reference 191.

A second tank 110 is mounted on the robot 101 in the vicinity of the tank 107 and is intended to be filled with cleaning product, like tank 10 of the first embodiment.

A third tank 120 is also mounted on the robot 101 in the vicinity of the tank 107 and is intended to receive the residues of cleaning of the elements 107, 108 and 109, except for those corresponding to the cleaning of the terminal part 108*a* of the sprayer 108, which may be rejected in the booth, as they are of very small volume. In a variant, a container of the type of container 20 of the first embodiment might by provided.

In practice, the tanks 110 and 120 are adjacent to the plate 109.

As previously, connectors 171 and 172 are provided on the tank 107 in order to cooperate with connectors 111 and 113 provided at a fixed station in the booth C, the connectors 111 and 113 being respectively connected to a unit $\mathbf{111}_2$ for changing coating product and to a source $\mathbf{113}_2$ of cleaning product. A third connector 173 is provided on the tank 107 to cooperate with a connector 114 installed at a fixed station on the partition 112 of the booth C and connected by a conduit $\mathbf{114}_1$ to a dump $\mathbf{114}_2$.

In this way, at the end of a cleaning operation of elements 107, 108 and 109, the tank 107 may be brought opposite the connectors 111, 113 and 114, which makes it possible to fill the tanks 107 and 110 respectively with coating product and cleaning product and to empty the tank 120 towards the dump $\mathbf{114}_2$.

Figure 5:
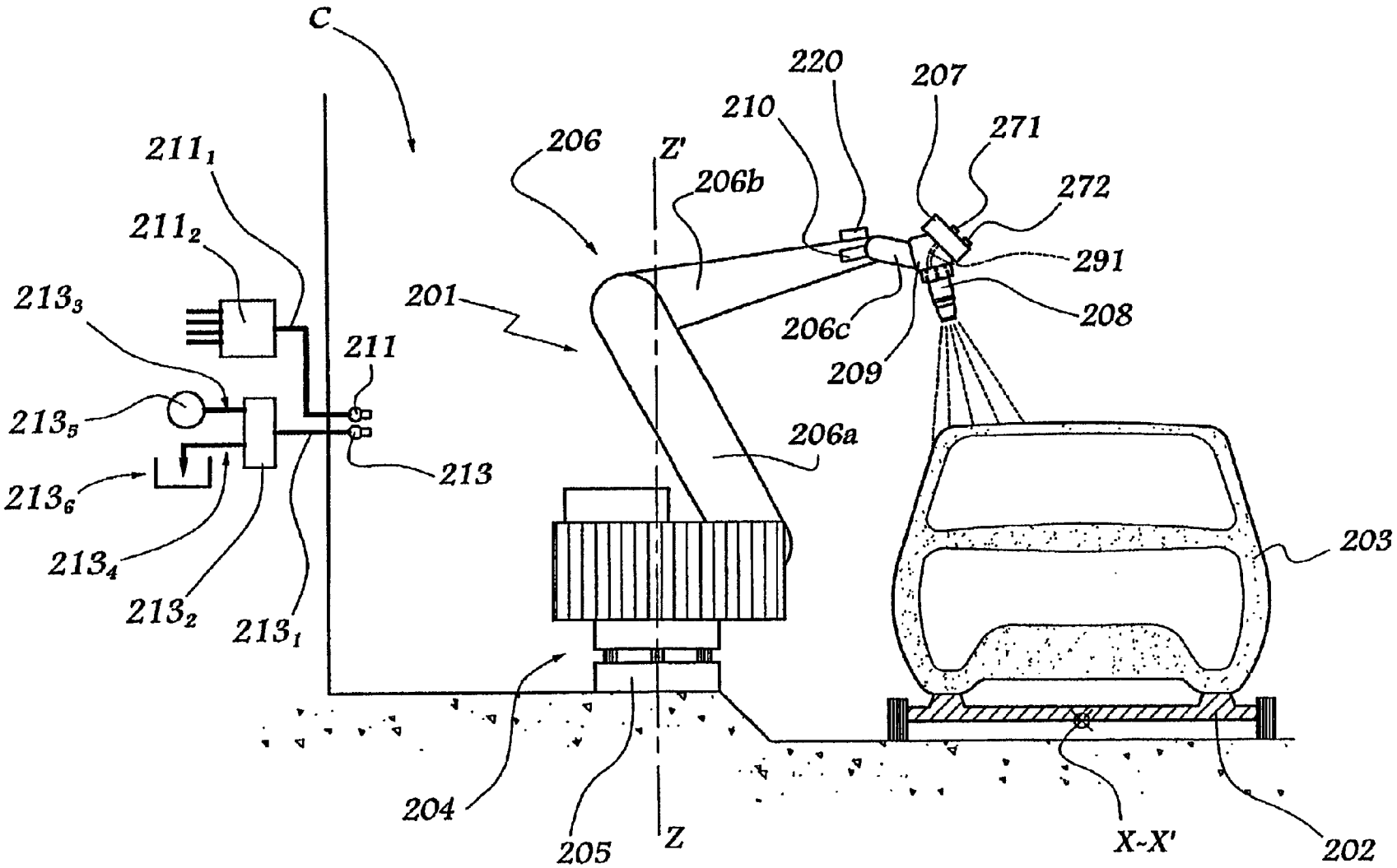
FIG. 5 is a view similar to FIG. 1 for an installation in accordance with a fourth form of embodiment of the invention.

In the fourth embodiment of the invention shown in FIG. 5, elements similar to those of the first embodiment bear identical references increased by 200. The robot 201 of this embodiment is disposed opposite a conveyor 202 over which automobile vehicle bodies 203 transit. This robot 201 comprises a chassis 204 mounted on a guide 205 as well as an arm 206 comprising a plurality of segments 206*a*, 206*b* and 206*c*. As previously, a tank 207 is mounted on the segment 206*c* and is associated with an electrostatic sprayer 208 thanks to conduits arranged in a plate 209, one conduit being visible in FIG. 5 with reference 291.

A tank 210 of cleaning product is provided on the robot 201 in the vicinity of the tank 207, as well as a tank 220 for collecting the residues of cleaning of elements 207 to 209.

Two connectors 271 and 272 are provided on the tank 207 in order to cooperate respectively with connectors 211 and 213 provided at a fixed station on the partition 212 of the booth C in which the robot 201 is installed. The connector 211 is connected by a conduit $\mathbf{211}_1$ to a unit $\mathbf{211}_2$ for changing coating product. The connector 213 is connected by a conduit $\mathbf{213}_1$ to a three-way valve $\mathbf{213}_2$ itself connected by conduits $\mathbf{213}_3$, $\mathbf{213}_4$ to a source $\mathbf{213}_5$ of cleaning product and to a dump $\mathbf{213}_6$.

Tanks 210 and 220, which are in practice adjacent the plate 209, may present sufficient capacities to allow them not to be filled or dumped every time the tank 207 is connected to the connector 211. In this way, the connectors 272 and 213 may be provided to be used alternately in order to place the source $\mathbf{213}_5$ and the tank 210 in communication, and the tank 220 and the dump $\mathbf{213}_6$ in communication.

In a variant embodiment, the tanks 210 and 220 may be provided to be respectively filled and emptied each time that the tank 207 is connected to the source of coating products, the tank 210 firstly being filled from the source $\mathbf{213}_5$, then the three-way valve $\mathbf{213}_2$ being tipped towards its second position where it allows the contents of the tank 220 to be poured towards the dump $\mathbf{213}_6$.

In a variant, the pouring of the contents of the tank 220 may be effected before the tank 210 is filled.

Whatever the embodiment considered, it may be provided to clean the tank of coating product, the sprayer and the conduits associated therewith, thanks to these streams of air and cleaning product.

The second tanks 10, 110 and 210 of an installation according to the invention are advantageously piston tanks or tanks with deformable wall, which makes it possible to control the flowrate of the cleaning product towards the cleaning members. In the same way, the third tanks 120 or 220 may likewise be constituted by piston tanks or tanks with deformable wall.

According to constructional variants, the second tanks 10, 110 and 120 are mounted on the robots permanently or removably. The same applies to the third tanks 120 and 220 which may be considered as optional equipment.

The invention has been described with a multi-axis robot. However, it is applicable independently of the exact type of robot, as long as a tank of coating product and a tank of cleaning product are integrated to a mobile part of this robot. It may be question of a reciprocator of a so-called "roof" machine or a so-called "lateral" machine.

What is claimed is:

1. Installation for spraying coating product comprising at least one robot of which a mobile part supports at least one sprayer and a tank of coating product connected thereto for feeding said sprayer, wherein said robot bears a second tank adapted to be filled with cleaning product, said second tank being connected in order to feed cleaning product to said tank of coating product, said sprayer and/or conduits connecting said tank of coating product to said sprayer.

2. The installation of claim 1, wherein said second tank presents an internal volume allowing it to contain a quantity of cleaning product sufficient to clean said tank of coating product, said sprayer and/or said conduits at least twice.

3. The installation of claim 1, wherein said second tank is mounted on said robot in the vicinity of the tank of coating product.

4. The installation of claim 1, wherein it comprises first connection means located at a fixed station in the vicinity of said robot and second connection means mounted on said robot and connected to said second tank, said first and second connection means being adapted to establish a connection between a circuit for feeding cleaning product and said second tank.

5. The installation of claim 4, wherein said second connection means are adapted to be connected to said first connection means when the first and second principal connection means, respectively provided at a fixed station and on said robot, are connected for filling said tank of coating product.

6. The installation of claim 4, wherein said first principal connection means comprise different connectors each connected to a circuit for feeding a predetermined coating product, a first connection means for feeding the second tank being disposed in the vicinity of each connector.

7. The installation of claim 1, wherein said robot bears a third tank connected to said tank of coating product, to said sprayer and/or to conduits connecting said tank to said sprayer, said third tank being adapted to receive at least a part of the residues of cleaning of said tank of coating product, of said sprayer and/or of said conduits.

8. The installation of claim 7, wherein said third tank is mounted on said robot in the vicinity of the tank of coating product and of the second tank.

9. The installation of claim 7, wherein it comprises means for connecting said third tank to a dump circuit.

10. The installation of claim 1, wherein said second tank and possibly said third tank are piston tanks.

11. The installation of claim 1, wherein said second tank and possibly said third tank are tanks with deformable wall.

12. Process for cleaning an installation for spraying coating product comprising a tank of coating product and a sprayer associated therewith, said tank and/or said sprayer being mounted on a robot, wherein it comprises a step consisting in feeding said tank, said sprayer and/or the conduits connecting said tank to said sprayer, with cleaning product from a second tank mounted on the robot.

13. The process of claim 12, wherein feed of said tank of coating product, of said sprayer and/or of said conduits with cleaning product from the second tank is effected at the end of a step of spraying of coating product.

14. The process of claim 13, wherein said tank of coating product, said sprayer and/or said conduits are fed with cleaning product from the second tank before the tank of coating product is filled again.

15. The process of claim 14, wherein it comprises a step consisting in pouring the contents of said third tank in a dump circuit.

16. The process of claim 15, wherein the step consisting in pouring the contents of the third tank towards the dump circuit and/or the step consisting in filling the second tank take place simultaneously to the filling of the tank of coating product.

17. The process of claim 15, wherein it comprises steps consisting in alternately connecting said second tank to a circuit for feeding cleaning product and said third tank to said dump circuit, using common connection means provided on said robot.

18. The process of claim 15, wherein the step of pouring the contents of the third tank takes place after a step of filling said second tank with cleaning product.

19. The process of claim 15, wherein the step of pouring the contents of the third tank takes place before a step of filling the second tank with cleaning product.

20. The process of claim 12, wherein the second tank is fed with cleaning product at the same time as the tank of coating product is filled.

21. The process of claim 12, wherein the residues of cleaning of said tank of coating product, of said sprayer and/or of said conduits are at least partly stored temporarily in a third tank mounted on said robot.

22. The process of claim 12, wherein said tank of coating product, said sprayer and said conduits are cleaned by streams of air and cleaning product.

* * * * *